US005464059A

United States Patent [19]

Kristiansen

[11] Patent Number: 5,464,059

[45] Date of Patent: Nov. 7, 1995

[54] APPARATUS AND METHOD FOR SUPPLYING FLUID INTO DIFFERENT ZONES IN A FORMATION

[75] Inventor: Terje Kristiansen, Radal, Norway

[73] Assignee: Den Norske Stats Oljeselskap a.s., Stavanger, Norway

[21] Appl. No.: 338,512

[22] PCT Filed: Mar. 25, 1994

[86] PCT No.: PCT/NO94/00065

§ 371 Date: Nov. 25, 1994

§ 102(e) Date: Nov. 25, 1994

[30] Foreign Application Priority Data

Mar. 26, 1993 [NO] Norway ..... 931128

[51] Int. Cl.[6] ..... E21B 33/24; E21B 33/138

[52] U.S. Cl. ..... 166/269; 166/222; 166/186; 166/305.1

[58] Field of Search ..... 166/269, 305.1, 166/222, 242, 186

[56] References Cited

U.S. PATENT DOCUMENTS

| | | | |
|---|---|---|---|
| 3,455,382 | 7/1969 | Chenowith | 166/269 |
| 3,825,070 | 7/1974 | Hoyt | 166/306 |
| 3,935,903 | 2/1976 | Arendt | 166/184 |
| 4,640,355 | 2/1987 | Hong et al. | 166/269 |
| 4,648,455 | 3/1987 | Luke | 166/242 X |
| 4,842,068 | 6/1989 | Vercaemer et al. | 166/269 |
| 4,921,044 | 5/1990 | Cooksey | 166/242 |
| 5,024,274 | 6/1991 | Schwab, Jr. | 166/269 |

OTHER PUBLICATIONS

"Products and Services", Otis Eng. Corp., Sep. 1989, pp. 235–238.

*Primary Examiner*—Stephen J. Novosad
*Attorney, Agent, or Firm*—Foley & Lardner

[57] ABSTRACT

There is discussed an apparatus for distributing fluid to at least two separate zones having higher (22) and lower (24) injectivity in a ground formation (10) through a pipe element in a well hole (12), where the pipe element by means of upper and lower sealing bodies (28,30) defines a space (30) which is adjacent to the zone (22) having a higher injectivity and which has a connection (16) to the zone, and where a fluid connection is established between the interior of the pipe element and the space via a replaceable flow pressure-regulating nozzle which establishes a given flow pressure for the current of fluid into the zone (22) having the higher injectivity. The apparatus is characterized in that the pipe element comprises an outer pipe section (40) and arranged internally relative to the latter an inner pipe section (42) the lower portion of which comprises means (54) for closing off the passage of fluid, that the space (32) between the inner (42) and the outer (40) pipe section forms a passage (66) for conveying fluid forward to the formation zone (24) having the lower injectivity, that the nozzle (58) is arranged in the inner pipe section (42), and that the inner pipe section (42), downstream of the nozzle (58), is designed with means (68) which form a fluid connection between the inner pipe section (42) and the annular space (32).

23 Claims, 3 Drawing Sheets

APPARATUS AND METHOD FOR SUPPLYING FLUID INTO DIFFERENT ZONES IN A FORMATION

The present invention relates to an apparatus for distributing a current of injection fluid to at least two separate zones having higher and lower injectivity in a ground formation which is penetrated by a well, where the apparatus comprises a pipe element, which by means of upper and lower sealing bodies, defines a space which is adjacent to the zone having the higher injectivity, and which has a connection to the zone, and where a fluid connection is established between the interior of the pipe element and the space via a nozzle which regulates the flow pressure of the current of fluid into the zone having the higher injectivity.

The flow-limiting nozzle is arranged connected to the pipe element in the fluid passage out to the space. Such nozzles are replaceable by means of a tool which is guided down into the well by means of a cable or the like. As fluid water is normally used.

The present invention has to do with the extraction of hydrocarbons (oil/gas) from hydrocarbon-conveying zones in a formation where it is desirable to increase the production by injecting fluid/water into the dissimilar zones via a single well. The reason that special measures are necessary during such injection of fluid into the formation zones, is that such zones have different pressures. The pressure in the zones, and thereby also the resistance to the inflow of fluid to the zones, will consequently vary. The fluid/water will therefore be able to be pumped more easily into the zone which has the lowest pressure, that is to say the higher injectivity, and one risks that little water, if any, reaches forward to the zone with the higher pressure, that is to say the lower injectivity.

This problem is solved by establishing a limitation of the flow of fluid into the zone with the higher injectivity (that is to say an increased pressure drop), in a manner such as is mentioned by way of introduction. The afore-mentioned pipe element has a given length and the nozzle is installed in a side wall pocket which is formed in the pipe element. Normally the space comprises an annular space which is defined by the pipe, the lining and the sealing elements.

In the side wall pocket the nozzle can be mounted and dismounted by means of a tool which is operated from the surface via a cable. The tool which is employed is called a switch over tool. By means of this arrangement a larger proportion of the quantity of fluid flows into the reservoir where the pressure is higher. If the pressure conditions between the formations change, it can be necessary to replace the nozzle with another nozzle which gives a new and more correct pressure drop into the zone which maintains the lowest pressure.

When the well exhibits large deviations from the vertical, it has been found however to be extremely problematic and time-consuming to lift and throw the cable switch over tool with the nozzle into the side wall pocket.

With this background it is an object of the present invention to produce a novel apparatus for injecting fluid into a number of zones of dissimilar injectivity, and where the afore-mentioned drawbacks with positioning the cable-operating tool, are totally eliminated.

The apparatus according to the present invention is characterised in that the pipe element comprises an outer pipe section and arranged internally in relation to the latter an inner pipe section the lower portion of which comprises means for closing off the fluid passage, that a space between the inner and the outer pipe section forms a passage for conveying fluid to the formation zone having the lower injectivity, that the nozzle is arranged in the inner pipe section, and that downstream of the nozzle the inner pipe section is designed with means which form a fluid connection between the inner pipe section and the annular space.

Further specified constructions of the apparatus according to the present invention are evident from the dependent patent claims.

By employing the apparatus according to the invention the result is that the tool which is used to operate the flow-limiting nozzle arrangement, will be centered without problems down in the inner pipe section directly over the nozzle arrangement. The tool therefore does not need, as previously, to be provided with special tool fittings for moving the tool in a lateral direction in order to meet the nozzle arrangement in the side wall pocket of the pipe section.

For a more detailed examination of the invention reference shall now be made to the accompanying Figures, in which.

In the different Figures like elements are designated by the same reference numerals.

Figure 1:
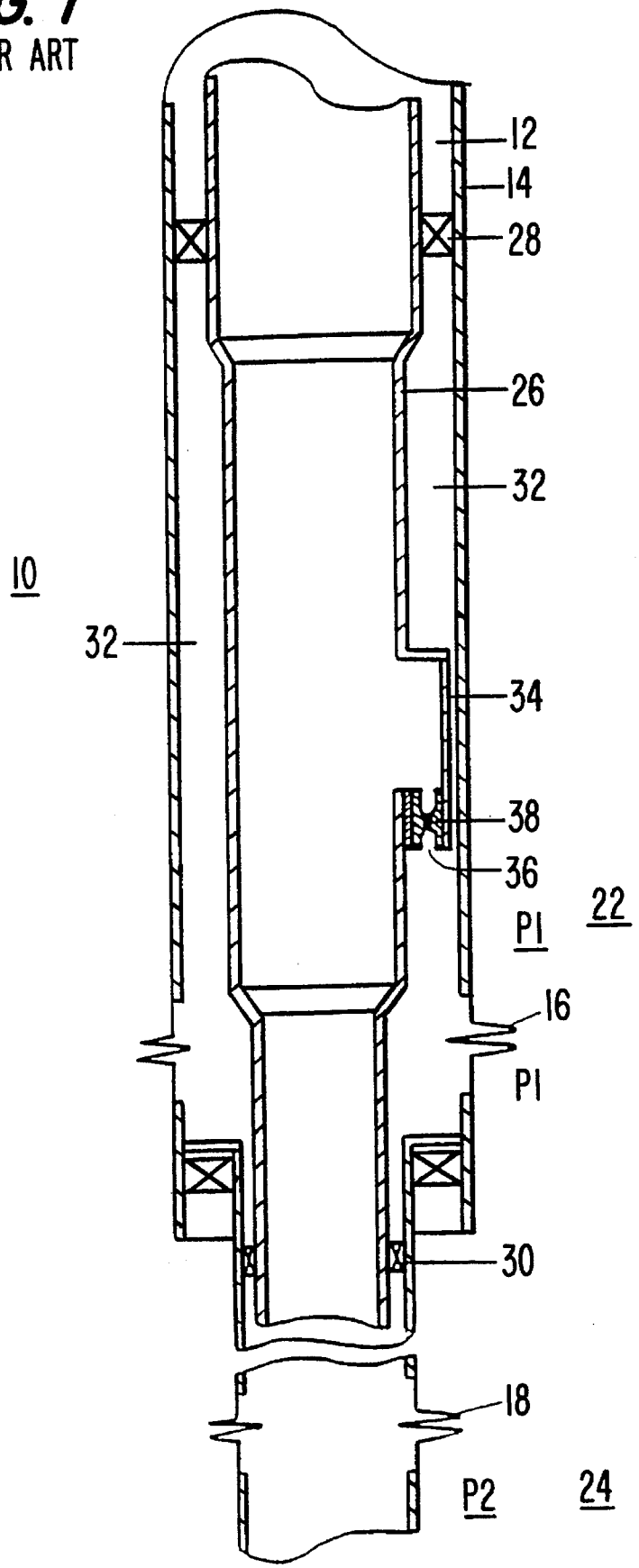
FIG. 1 PRIOR ART
FIG. 1 shows a side section of an arrangement according to a known solution for producing a flow limitation of that fluid which is to be injected in a formation zone of higher injectivity (lower pressure).

Reference shall now be made to FIG. 1 of the drawings which shows a side section of one of the known solutions for injecting fluid into two formation zones having dissimilar pressure conditions and flow characteristics. The ground formation itself is shown by the reference numeral 10. The formation 10 comprises two hydrocarbon-conducting zones 22,24 (that is to say oil-conducting zones) which are separated and bounded by an impermeable kind of formation which prevents communication between the zones. A well 12 is drilled down through the formation 10, and in the well 12 there is installed a lining pipe 14. In the lining pipe 14 and into the zones 22 and 24 in the formation 10 there are formed upper and lower perforations 16,18 which the injected fluid/water is led through to the respective zone. As indicated earlier the pressure P1 in the first formation zone 22, which borders up to the upper perforations 16, is lower than the pressure P2 in the other formation zone 24 which borders up to the lower perforations 18.

In such a situation where the injectivity is substantially greater in formation zone 22 than in formation zone 24, approximately all the fluid will flow into the zone 22, while little or no fluid reaches forward to the zone 24, if the flow pressure of the fluid (that is to say the pressure drop) into the zone 22, is not increased. In order to produce such an increased flow resistance there is installed in the lining pipe 14 a pipe section 26 (that is to say placed lowermost on an injecting or production pipe) having a given length. The pipe 26 is positioned in the lining pipe 14 by means of upper and lower sets of gaskets 28,30. More specifically these sets of gaskets 28,30 are placed respectively above and below the perforation 16 into the formation zone 22 having the lower pressure P1 (greatest injectivity). Since the pipe section 26 has a smaller diameter than the lining pipe 14 and is arranged mainly concentrically in the lining pipe 14, an intermediate annular space 32 is formed which is defined by the pipe section 26, the lining 14, and the upper and lower sets of gaskets 28,30. The perforation 16 for the connection into the formation zone 22, thereby empties out into the annular space 32.

Between the gaskets 28,30 the pipe section is designed with a sidewall pocket 34 having an opening 36 with a landing profile/seat with a place for a nozzle 38. The nozzle 38 can establish an increased flow pressure (pressure drop) into the zone 22 via the annular space 32, so that a larger proportion of the fluid pushes further downwards in the pipe 26 and into the zone 24 where the pressure is higher. By a suitable choice of flow pressure-regulating nozzle 38, the fluid which flows into the two mutually separated zones 22,24, can thus be distributed more correctly.

If the relationship between the pressures P1,P2 in the formation zones 22,24 changes, it can be necessary to substitute the nozzle 38 with a nozzle for obtaining an altered flow pressure into the zone 22. Such a replacement is carried out from the surface by means of a switch over tool ("kick over tool") which is lowered down in the pipe section 25 by means of a cable. As a consequence of the geometry for the system with the sidewall pocket as is shown in FIG. 1, and when the well deviates substantially from the vertical, there are problems with getting the tool via the cable to "meet" the nozzle 38 so that it can be replaced. More specifically this means that it can be very problematical to lift and move the switch over tool for positioning the tool over the nozzle in the sidewall pocket.

Moreover it will be evident that in FIG. 1 (also in FIG. 2) there is a transition to a smaller well diameter between the two zones 22 and 24.

Figure 2:
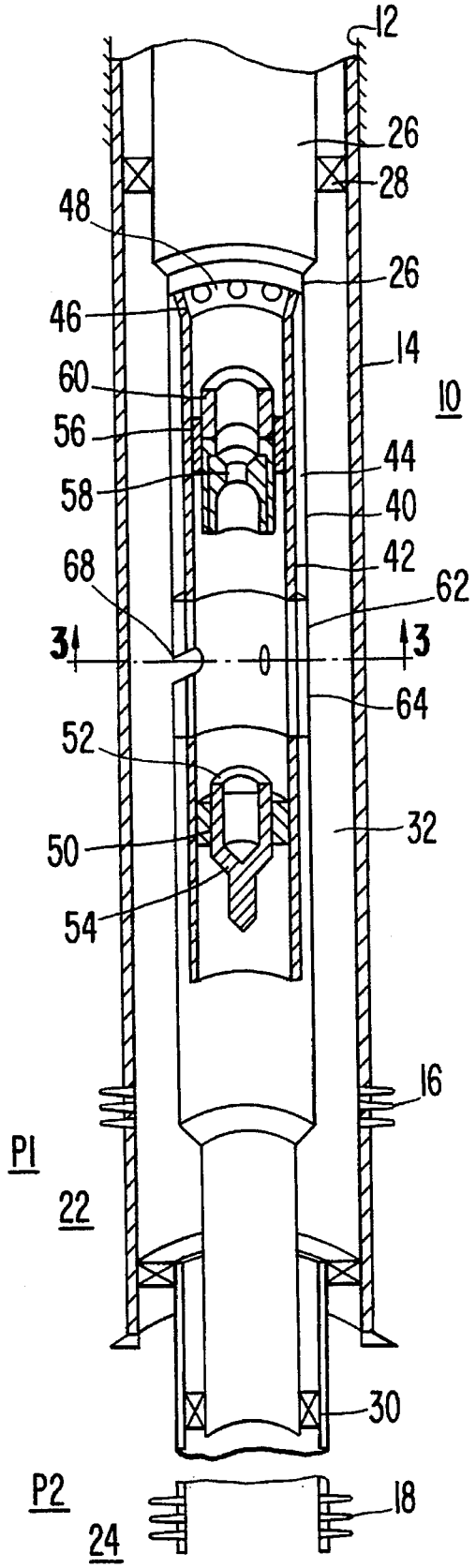
FIG. 2 shows a side view seen obliquely from above of the internal parts of an apparatus according to the invention, that is to say where the one pipe half is cut away longitudinally in a plane through the pipe.

Reference shall now be made to FIG. 2 which shows a nozzle arrangement according to the invention, and the starting point for this arrangement is the solution according to the state of the practice as is illustrated in FIG. 1.

A well hole 12 passes downwards through a fluid-conducting formation 10 and in the well there is installed a lining pipe 14. In the lining pipe 14 a pipe section 40 is arranged which is connected, for example by means of a screw coupling, to the lower end 26 of a strand of an injection pipe which stretches up to the surface. In connection with the pipe section 40 upper and lower sets of gaskets 28,30 are arranged which are positioned respectively above and below the perforation 16 into which a portion of the water is desired to be injected. Since the pipe section 40 has a smaller diameter than the lining pipe 14 in the well 12, and the section is arranged approximately concentrically in the lining pipe 14, an outer annular space 32 is formed which is defined by the outer side of the pipe section, the well lining 14 and the upper and lower gaskets 28,30. The perforations 16 for the connection into the formation zone 22 thereby borders up towards the annular space 32, while the perforations 18 lies lower down in the formation.

Internally in the pipe section 40, which in the following description shall be called the outer pipe section 40, an inner pipe section 42 is installed. The inner pipe section 42 is preferably positioned so that it is situated, within the outer pipe section 40, between the two gaskets 28,30. Furthermore the pipe section 42 is arranged concentrically within the outer pipe section 40. The inner pipe section 42 has a smaller outer diameter than the inner diameter for the outer pipe section 40, so that an annular space 44 is established between the two pipe sections 40,42 over the whole length of the inner pipe section 42.

In the upper portion the inner pipe section 42 is formed with a centering device 46 for guiding down and admitting a cable-operated (cable-driven) tool internally in the inner pipe section 42. The centering device 46 includes a number of ribs 48 which with mutual spacing from and along the upper periphery of the pipe section 42 extend obliquely upwards and outwards to the inner wall of the outer pipe section 40. The ribs 48 thus form a funnel shape which will simplify the positioning of the tool down in the inner pipe section.

Internally in the lower portion of the inner pipe section 42 a lower landing profile 50 is arranged having a locking element 52 for replaceably installing a plug 54 (for example a plug rod with gasket element). The plug 54 forms a stop for the current of fluid going internally downwards through the inner pipe section 42.

In the inner pipe section 42 there is arranged, between admitting device 46 and the lower nipple/landing profile 50, an upper nipple/landing profile 56 in which a flow pressure-regulating nozzle 58 is replaceably installed which is locked to the landing profile 56 by means of a locking element 60.

The nozzle element 58 and also the plug element 54 in the lower landing profile can as required be readily replaced in succession individually by means of the cable-operated tool which is guided down through the injection pipe.

A middle portion of the group of the pipe sections 40,42 is constituted by a pipe sleeve 62. The pipe sleeve 62 has essentially the same internal diameter as the pipe section 42 and approximately the same outer diameter as the outer pipe section 40. The wall thickness of the pipe sleeve 62 is thus approximately the same as the sum of the wall thicknesses for the two pipe sections 40,42 plus the breadth of the gap for the annular space 44.

Figure 3:
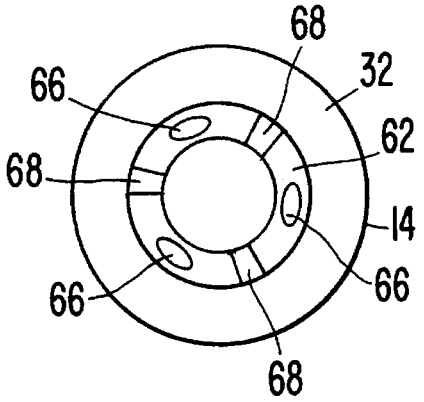
FIG. 3 shows a plan section through the sleeve insert of the pipe section in the region which is indicated by the line 3—3 of FIG. 2.

Referring also to FIG. 3, a number of mutually separate and through passages 66 are formed through the wall of the pipe sleeve 62. The passages 66 extend mainly parallel (coaxial) to the longitudinal central axis of the sleeve. Consequently the passages 66 form a connection between the annular space regions **44*a*,44*b* which are situated respectively upstream and downstream of the pipe sleeve 62**.

In the region of the pipe sleeve 62 which is not bored through by any coaxially directed passage 66, a number of ducts 68 are formed through the wall of the pipe sleeve 62. In this way a connection is established between the region internally in the inner pipe section 42 above the plug 50 and to the annular space 32 on the outside of the outer pipe section 40. To begin with each duct 68 can be radially directed through the wall of the pipe sleeve 62, but they are preferably formed in an oblique direction from above and downwards reckoned from the upstream side of the ducts 68 and it is this situation which is illustrated in FIG. 2.

Concerning the number of the afore-mentioned coaxial passages 66 and radial ducts 68 through the wall of the pipe sleeve reference is made to FIG. 3 which is a horizontal section through the pipe sleeve 62, the annular space 32 and the lining pipe 14 in the region which is indicated by the line 3—3 of FIG. 2. In this construction three coaxial passages 66 and three radial ducts 68 are preferably formed in the pipe sleeve 62. The passages 66 and the ducts 68 are consequently arranged at a mutual angular spacing of 120° respectively. The present invention however shall not be limited to the number of passages and ducts mentioned above, the number being able to be chosen freely from that which according to practice will be appropriate. It can also be of interest to design the passages and ducts in a non-regular pattern.

Preferably the passages 66 are formed so that they provide the largest possible flow cross-section from what the wall thickness of the pipe sleeve gives space for and also how closely the adjacent ducts 68 are situated. As is evident from FIG. 3 the passages 66 have an oval cross-section, but they can also be circular or exhibit any other suitable flow cross-section. A corresponding evaluation of the flow cross-section applies to the ducts 68. It is an advantage that the passages 66 and the ducts 68 are formed so that they produce the least possible resistance against the through flow of fluid.

The mode of function for the apparatus according to the invention to distribute the fluid (the liquid) pumped down into two separated branch currents for the formation zone 22 having the lower pressure P1 and for the formation zone 24 having the higher pressure P2, shall be explained in the following description reference being made to FIG. 4.

Figure 4:
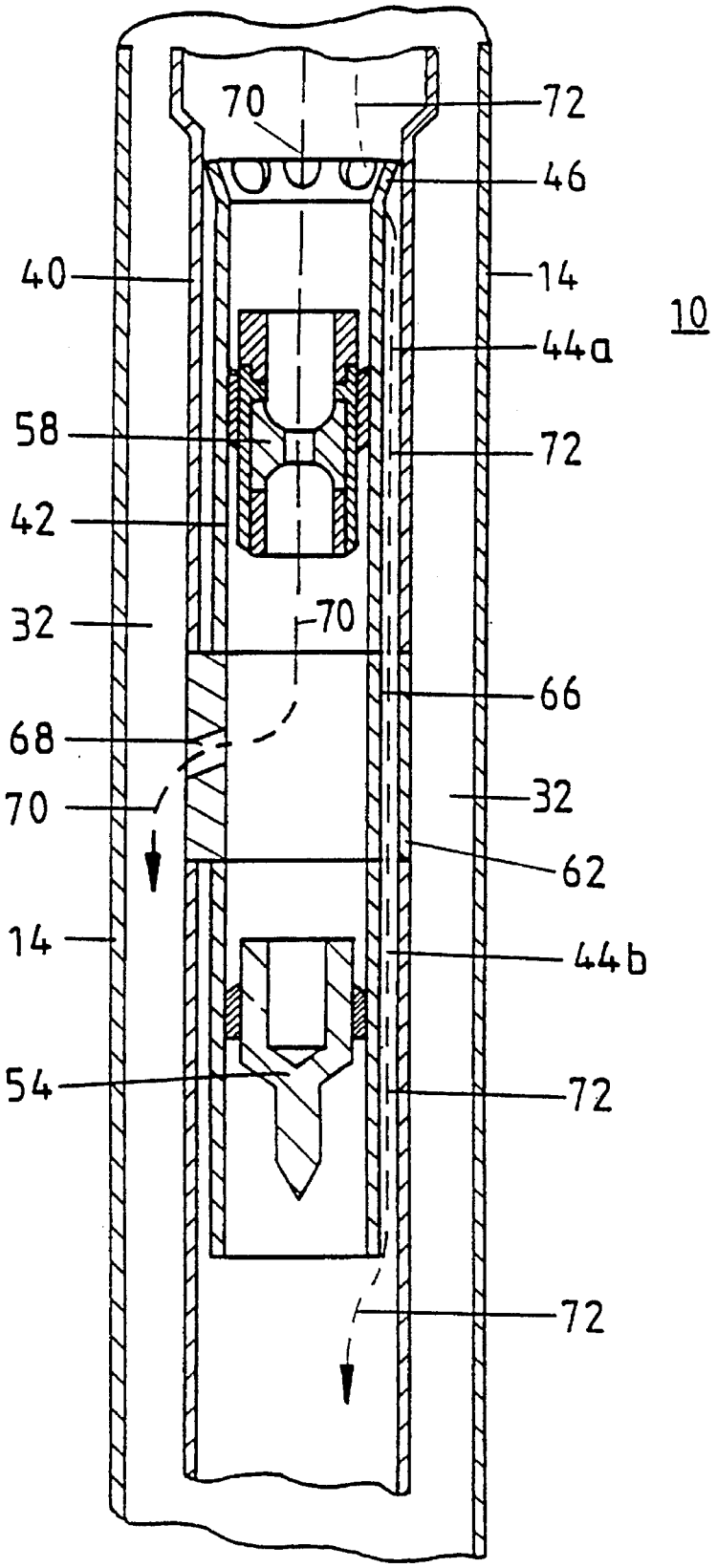
FIG. 4 shows a cross-section of the central parts of the novel apparatus according to the invention in order to illustrate the flows in the two separate branch paths.

The fluid which is pumped down to the formations 22 and 24 is divided by the centering device 46 into a first and a second current of fluid as follows:

The first current of fluid is indicated in FIG. 4 by a dotted line 70, and goes through the inner pipe section 42, through the nozzle 58 where an increased flow pressure or pressure drop is established, further through the sleeve 64, and approximately radially across through the ducts 68 in the sleeve 62 and into the annular space 32 and forward to the formation zone 22 having the lower pressure P1. It will be evident that further flowing downwards through and out of the inner pipe section 42 is prevented by the bottom plug 54.

The second current of fluid is illustrated as a dotted line 72 and is established in the annular space 44*a* between the inner and outer pipe sections 40,42 and further downwards to the formation zone 24 having the higher pressure P2. More specifically the fluid is led uppermost at the centering device 46 in between the ribs 48, out into the annular space 44*a* upstream of the sleeve 62, through coaxial passages 66 of the sleeve, downwardly through the annular space 44*b* downstream of the sleeve 62 and further down to the zone 24.

The centering device 46 is, as is evident from FIGS. 2 and 4, preferably positioned at a distance upstream of the nozzle arrangement 58. Consequently the two branch currents 70 and 72 can be logged and determined by only measuring the condition of the branch current 70 at a distance upstream of the nozzle element 58.

With the apparatus according to the present invention for fluid distribution in formation zones having dissimilar pressures a very simplified replacing of the nozzle element 58 is achieved. This is due to the nozzle 58 and the plug 54 with their respective locking means 52,60 being approximately centered relative to the down run through the injection pipe. The whole unit of the elements in the outer pipe section 40 and the inner pipe section 42 is centered in the well. The tool which is lowered down in the injection pipe is centered automatically, something which is further simplified as a consequence of the upper funnel-shaped centering device 46 of the inner pipe section 42. The drawback with the earlier necessary use of the switch over tool referred to is thereby totally eliminated.

The nozzle element 58 can produce an increased flow pressure for the current of fluid into the formation zone 22 through the perforations 16. When the conditions in the well change, the nozzle element can be easily loosened, brought up and replaced with another nozzle element suitable for the new situation in the well. This replacing occurs by means of a cable-driven tool which is centered without any problems down in the pipe 42 via the aforementioned centering arrangement 46.

It will be evident besides that the apparatus according to the invention is, in a mounted position, upwardly open towards the injection pipe, and that it is closed off in the bottom by means of the replaceable plug. Furthermore the flow of fluid through the apparatus according to the invention occurs from above and downwards without any change in the direction of flow.

An alternative construction of the apparatus according to the invention can be designed approximately as the solution which is discussed above, but with the difference that the middle pipe sleeve 62 with the passages 66 and the ducts 68 is omitted. This can be carried out by arranging the inner pipe section 42 over the whole of its length concentrically internally in the outer pipe section 40. The transverse fluid passage between the interior of the inner pipe section 42 and the annular space 32 can then be established by means of a number of radially extending pipe connections. The pipes are placed in the region between the nozzle element 58 and the plug 54, that is to say in a corresponding position as for the ducts 68 through the pipe sleeve 62. In addition to the above centering arrangement 46 the pipes 40,42 are centered/positioned relative to each other by means of said pipe connections, and/or by means further of a number of space ribs which are placed between the two pipe sections at a regular distance around the periphery. In this manner the fluid/liquid of the branch current 72 can flow largely unhindered downwards between the ribs.

If it is desired to establish a free flow-through through the inner pipe section and further down in the well, the nozzle 58 and the bottom plug 54 can in succession be uncoupled and taken up to the surface by means of the cable-driven tool.

I claim:

1. Apparatus for distributing a current of injection fluid to at least two separate zones (22,24) having higher and lower injectivity in a ground formation (10) which is penetrated by a well (12), the apparatus comprising a pipe element, which by means of upper and lower sealing bodies (28,30), defines a space (32) adjacent to a zone (22) having higher injectivity, the space having a connection to the zone, and where a fluid connection is established between an interior of the pipe element and the space via a nozzle (58) which regulates a flow pressure for a current of fluid into the zone having the higher injectivity, the pipe element having a unit comprising an outer pipe section (40) and arranged internally relative to the latter, an inner pipe section (42), a lower portion of the inner pipe section comprising means (54) for closing off the passage of fluid such that a space between the inner (42) and the outer (40) pipe section forms a passage (66) for conveying fluid forward to formation zone (24) having a lower injectivity, the nozzle (58) being arranged in the inner pipe section (42), and downstream of the nozzle (58), the inner pipe section (42) being formed with means (68) for forming a fluid connection between the inner pipe section (42) and the annular space (32).

2. Apparatus in accordance with claim 1, wherein the inner pipe section (42) is arranged concentrically relative to the outer pipe section (40), and has a smaller diameter than the outer pipe section for establishing the passage in the form of an annular space (44) between the pipe sections.

3. Apparatus in accordance with claim 1, wherein the nozzle (58) is arranged at a distance downstream of a tool positioning means (46).

4. Apparatus in accordance with claim 1, wherein a section of the unit of the inner pipe section and the outer pipe section comprising a sleeve element (62) wherein the passage is formed by a number of mutually separate passages (66) formed mainly parallel to an axis of the sleeve (62), through wall of the sleeve, and the means forming the fluid connection comprises ducts (68) formed in an approximately radial direction through the wall of the sleeve.

5. Apparatus in accordance with claim 4, wherein the sleeve (62) comprises a number of passages and ducts (66,68) which are arranged alternately and with a mutual spacing around a periphery of the sleeve (62).

6. Apparatus in accordance with claim 4, wherein the ducts (68) are formed in an oblique direction from above and downwards from an upstream side of the ducts.

7. Apparatus in accordance with claim 4, wherein the passages (66) have a rounded off oval cross-section, and the ducts (68) have an oval cross-section.

8. Apparatus in accordance with claim 4, wherein the wall thickness of the sleeve element (62) is approximately equal to the sum of a wall thickness for the lower and outer pipe sections (40,42) plus a breadth of a gap for the space (44).

9. Apparatus in accordance with claim 4, wherein a largest radial breadth of the ducts (68), in cross-section, is approximately equal to the breadth of a gap of the space (44*a*,44*b*) space formed between the inner and outer pipe sections, upstream and downstream of the sleeve element (62).

10. Apparatus in accordance with claim 1 wherein the inner pipe section (42), upstream of the nozzle further, comprises means (46) for the positioning of a tool which is lowered down from above for replacing the nozzle, and for operating the means (54) which closes off the further passage of fluid downwards through the inner pipe section.

11. Apparatus in accordance with claim 10, wherein the positioning means (46) is fastened in an upper edge portion of the inner pipe section (42) and is localised against the inner wall of the outer pipe section (40) to form a centering acting element, the means having a number of mutual separate ribs (48) around a peripheral circumference of the pipe section (42) which are extended outward and obliquely upwards to the outer pipe section (40).

12. A method of distributing a current of injection fluid to at least two separate zones (22,24) having higher and lower injectivity in a ground formation, comprising the steps of:

providing a pipe element within the well, the pipe element having an inner and outer pipe section sections (40,42), the inner pipe section being internal of the outer pipe section and provided with a means (54) for closing off the passage of injection fluid;

creating a passage (66) for conveying injection fluid to the zone having the lower injectivity between the inner tube, inner and outer pipe sections;

defining a space in the wall adjacent the one with higher injectivity by placing upper and lower sealing bodies between the pipe element and the well;

providing passages means (68) in the inner pipe section to establish in fluid connection between an interior of the pipe element and space; and regulating the flow of fluid in the fluid connection by a nozzle (58).

13. A method according to claim 12, further comprises:

providing the inner pipe section concentrically with the outer pipe section; and establishing the passage for conveying fluid by providing the inner pipe section with a smaller diameter than the outer pipe section.

14. A method according to claim 12, further comprising:

providing the nozzle downstream of a tool position means.

15. A method according to claim 12, further comprising:

providing a sleeve element for a portion of the inner and outer pipe sections; and forming the sleeve element with a plurality of mutually separate axial passages and a plurality of radial extending fluid connection ducts.

16. A method according to claim 15, wherein the axial passages and ducts are arranged alternatively with mutual spacing around spacing wound periphery of the sleeve.

17. A method according to claim 15, wherein the ducts are formed in an oblique direction from above and downwards from an upstream side of the ducts.

18. A method according to claim 15, wherein the passages have a rounded off oval cross-section and the ducts have an oval cross-section.

19. A method according to claim 15, wherein a wall thickness of the sleeve element is approximately equal to the sum of a wall thickness of both inner and outer pipe sections and a breadth of the passage for conveying injection fluid.

20. A method according to claim 13, wherein a radial breadth of the passage means (68) is approximately equal to the breadth of the passage (66).

21. A method according to claim 13, wherein the inner pipe section is provided with a means for positioning a tool, the tool being provided from above for replacing the nozzle and operating the means (54) for closing off the passage of injection fluid.

22. A method according to claim 21, wherein the positioning means is fastened in an upper edge portion of the inner pipe section to form a centering acting element.

23. A method according to claim 22, wherein the centering acting element comprises a number of mutual separate ribs extending outward and obliquely from a peripheral circumference of the inner pipe section toward the outer pipe section.

* * * * *